US011633075B1

(12) United States Patent
Woodley

(10) Patent No.: US 11,633,075 B1
(45) Date of Patent: Apr. 25, 2023

(54) SATIN TOWEL

(71) Applicant: Anitha Woodley, Charlotte, NC (US)

(72) Inventor: Anitha Woodley, Charlotte, NC (US)

( * ) Notice: Subject to any disclaimer, the term of this patent is extended or adjusted under 35 U.S.C. 154(b) by 182 days.

(21) Appl. No.: 17/122,345

(22) Filed: Dec. 15, 2020

Related U.S. Application Data

(60) Provisional application No. 62/948,348, filed on Dec. 16, 2019.

(51) Int. Cl.
*A47K 10/02* (2006.01)

(52) U.S. Cl.
CPC ..... *A47K 10/02* (2013.01)

(58) Field of Classification Search
CPC ..... A47K 10/02; A41D 3/08; A41D 15/04; A42B 1/041; A45D 44/08
See application file for complete search history.

(56) References Cited

U.S. PATENT DOCUMENTS 3,590,864 A * 7/1971 Vechesloff ..... A45F 4/14 135/96
9,877,522 B1 * 1/2018 Martinson ..... A41B 17/005
11,225,734 B1 * 1/2022 Solano ..... A47K 10/02
2006/0037555 A1 * 2/2006 Jackson ..... A01K 13/00 119/601
2009/0176049 A1 * 7/2009 Maughn-Haas ..... A47K 10/02 428/68
2012/0124740 A1 * 5/2012 Castle ..... A47D 15/003 5/420
2021/0361052 A1 * 11/2021 Craft ..... A45D 44/08

FOREIGN PATENT DOCUMENTS

CN 208974332 U * 6/2019

* cited by examiner

*Primary Examiner* — Ko H Chan
(74) *Attorney, Agent, or Firm* — Kyle A. Fletcher, Esq.

(57) ABSTRACT

The satin towel is a composite textile structure. The satin towel is configured for use in drying hair. The satin towel incorporates an absorbent sheeting and one or more satin sheetings. The one or more satin sheetings attach to the absorbent sheeting such that each of the one or more satin sheetings forms an exterior surface of the satin towel. The absorbent sheeting wicks water through the one or more satin sheeting. Each of the one or more satins sheetings presents a low abrasion surface that is rubbed against the hair.

17 Claims, 5 Drawing Sheets

SATIN TOWEL

CROSS REFERENCES TO RELATED APPLICATIONS

This non-provisional application claims priority under 35 USC 119(e) to United States provisional application U.S. 62/948,348 filed on Dec. 16, 2019. This non-provisional application claims United States provisional application U.S. 62/948,348 in its entirety.

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of a layered product built up of flat strata, more specifically, a layered fabric incorporating one or more woven layers. (B32B5/024)

BACKGROUND

A typical towel is an absorbent structure formed from coarse (heavy denier) yarns and fibers. The coarse nature of a typical towel causes an abrasion when the typical towel is rubbed against the hair of a user. Specifically, when a typical towel is rubbed against the hair, a friction is generated that breaks the tertiary and quaternary structures of the proteins that make up the hair such that the hair forms what is commonly called "frizz." Clearly, a towel capable of drying hair while reducing the damage caused to the hair by a typical towel would be of benefit.

SUMMARY OF INVENTION

The satin towel solves the problem described above. The satin towel is a composite textile structure. The satin towel is configured for use in drying hair. The satin towel comprises an absorbent sheeting and one or more satin sheetings. The one or more satin sheetings attach to the absorbent sheeting such that each of the one or more satin sheetings forms an exterior surface of the satin towel. The absorbent sheeting wicks water through the one or more satin sheeting. Each of the one or more satins sheetings presents a low abrasion surface that is rubbed against the hair.

These together with additional objects, features and advantages of the satin towel will be readily apparent to those of ordinary skill in the art upon reading the following detailed description of the presently preferred, but nonetheless illustrative, embodiments when taken in conjunction with the accompanying drawings.

In this respect, before explaining the current embodiments of the satin towel in detail, it is to be understood that the satin towel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the satin towel.

It is therefore important that the claims be regarded as including such equivalent construction insofar as they do not depart from the spirit and scope of the satin towel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
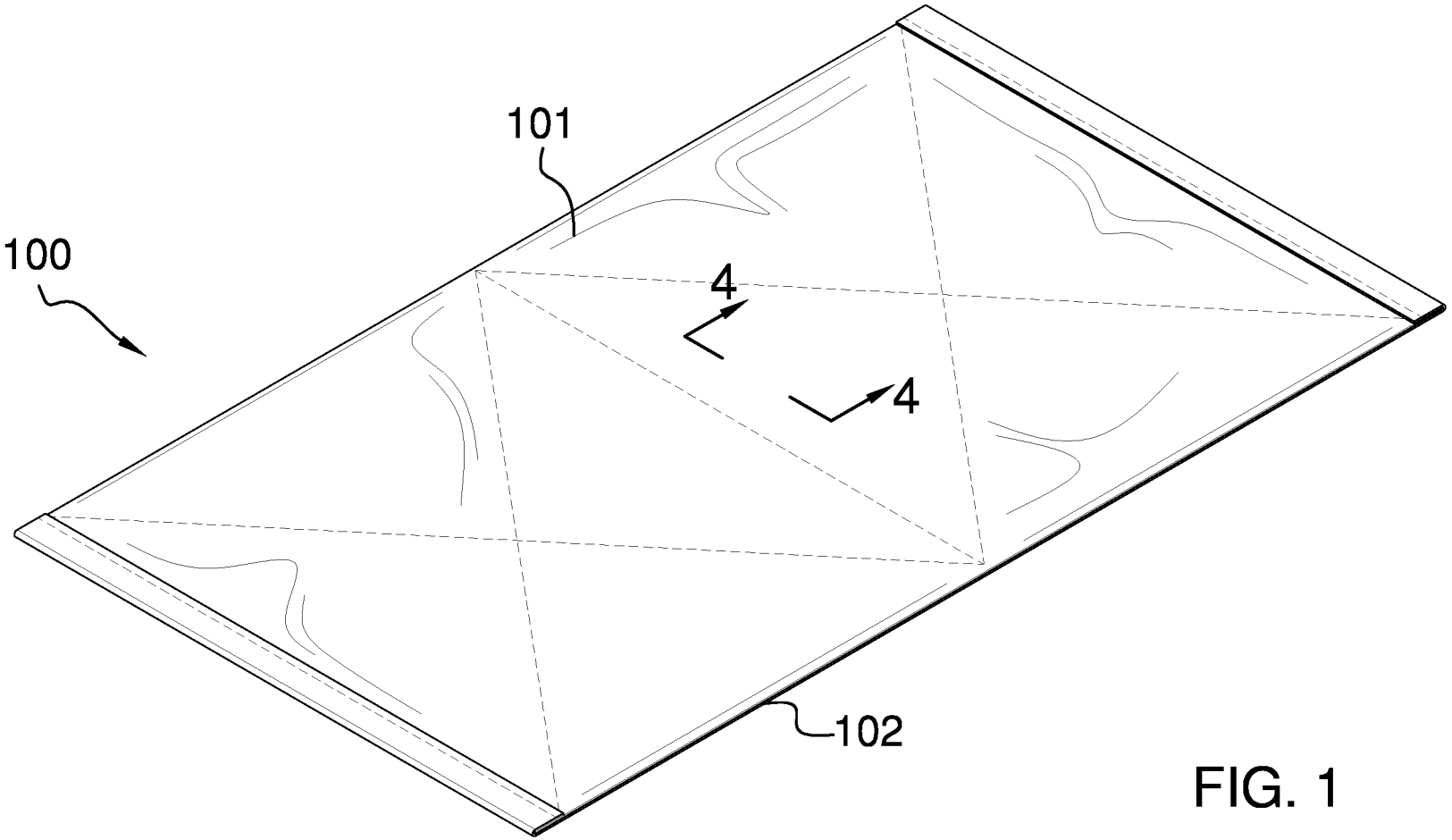
FIG. 1 is a perspective view of an embodiment of the disclosure.
Figure 2:
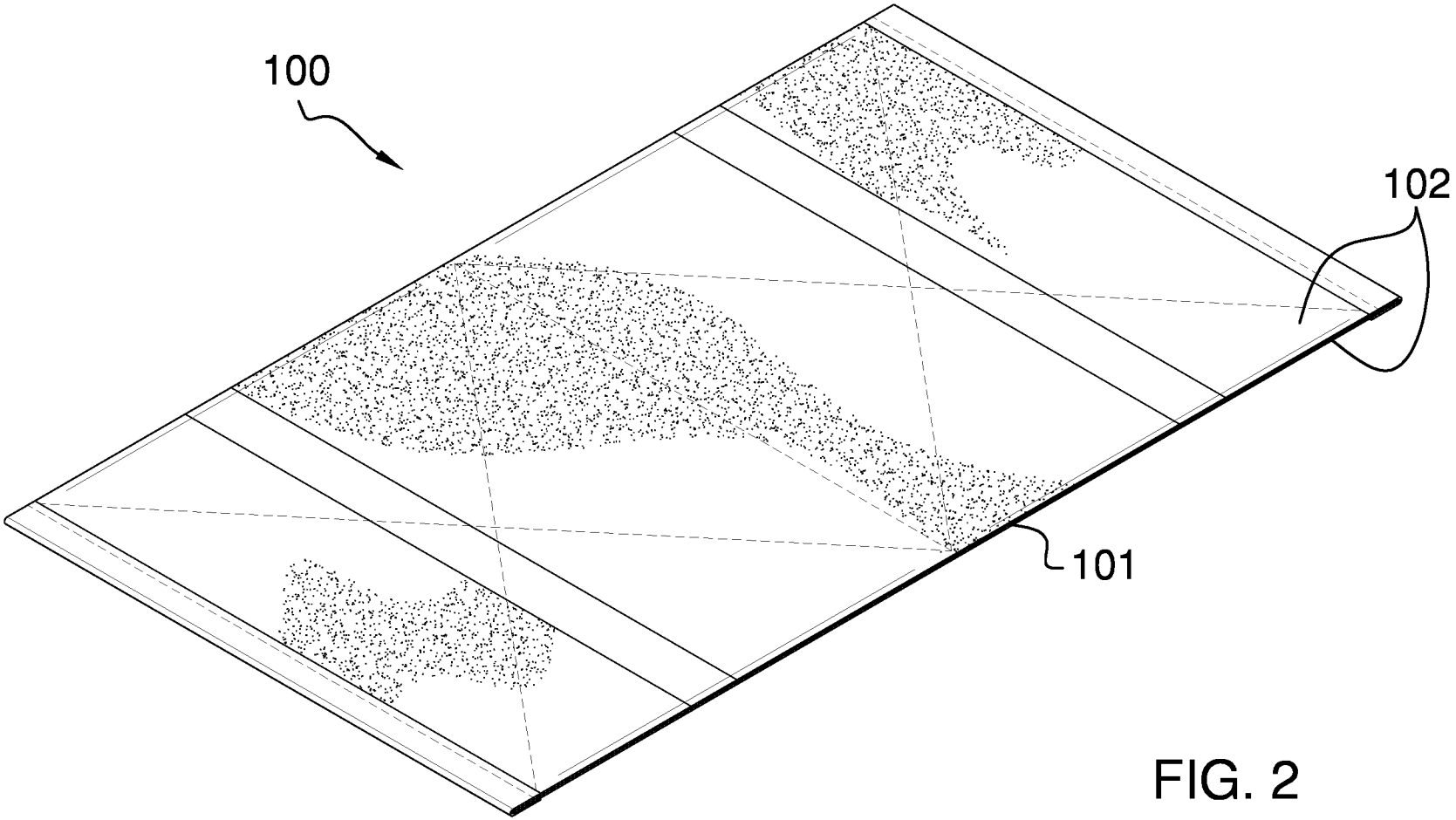
FIG. 2 is a reverse perspective view of an embodiment of the disclosure.
Figure 3:
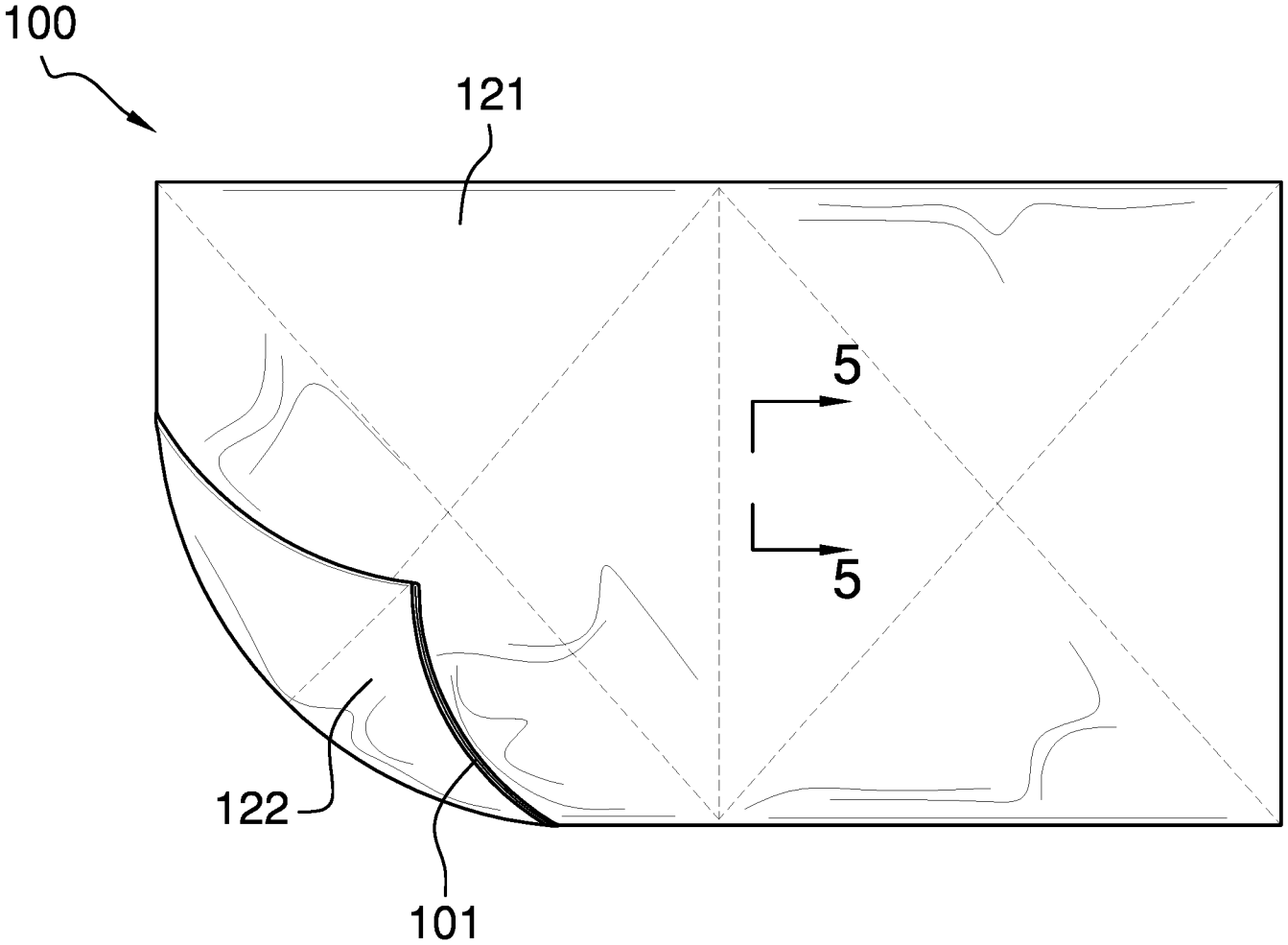
FIG. 3 is a front view of an embodiment of the disclosure.
Figure 4:
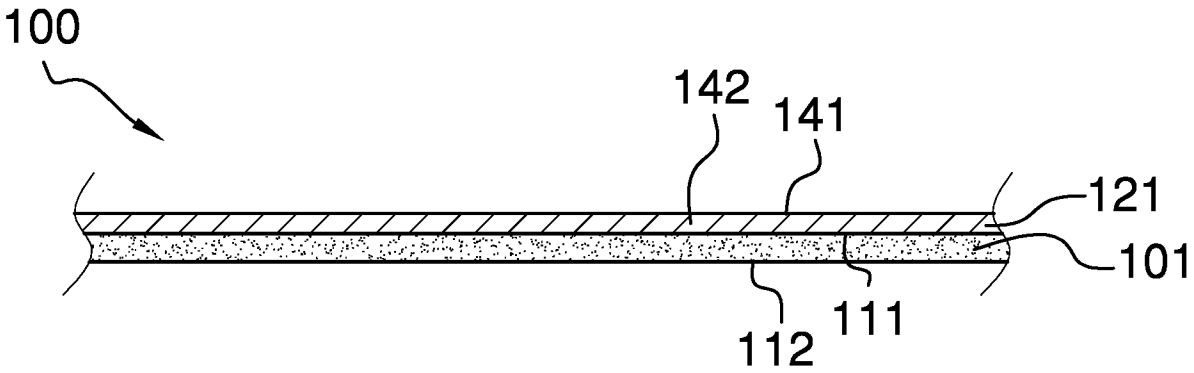
FIG. 4 is a cross-sectional view of an embodiment of the disclosure across 4-4 as shown in FIG. 1.
Figure 5:
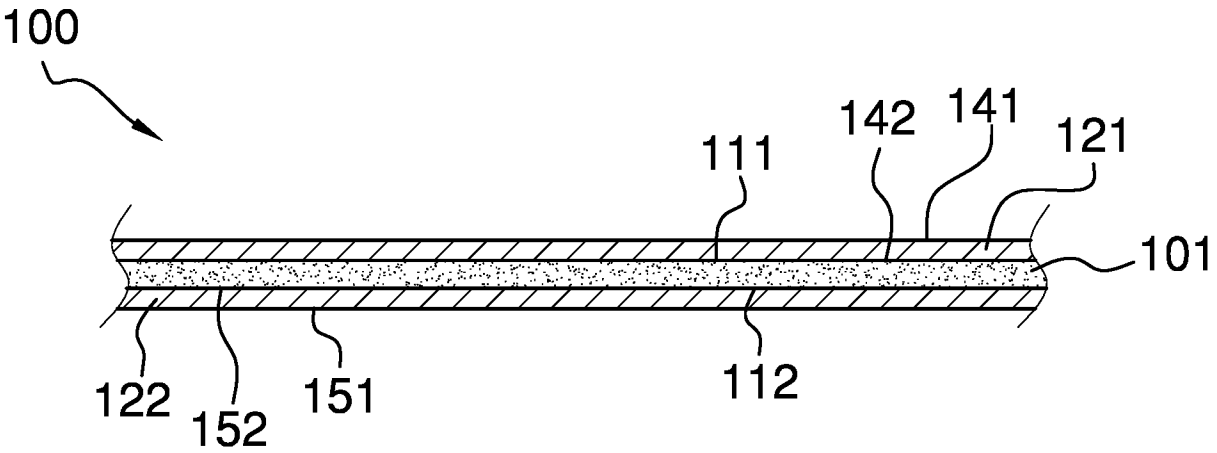
FIG. 5 is a cross-sectional view of an alternate embodiment of the disclosure across 5-5 as shown in FIG. 3.
Figure 6:
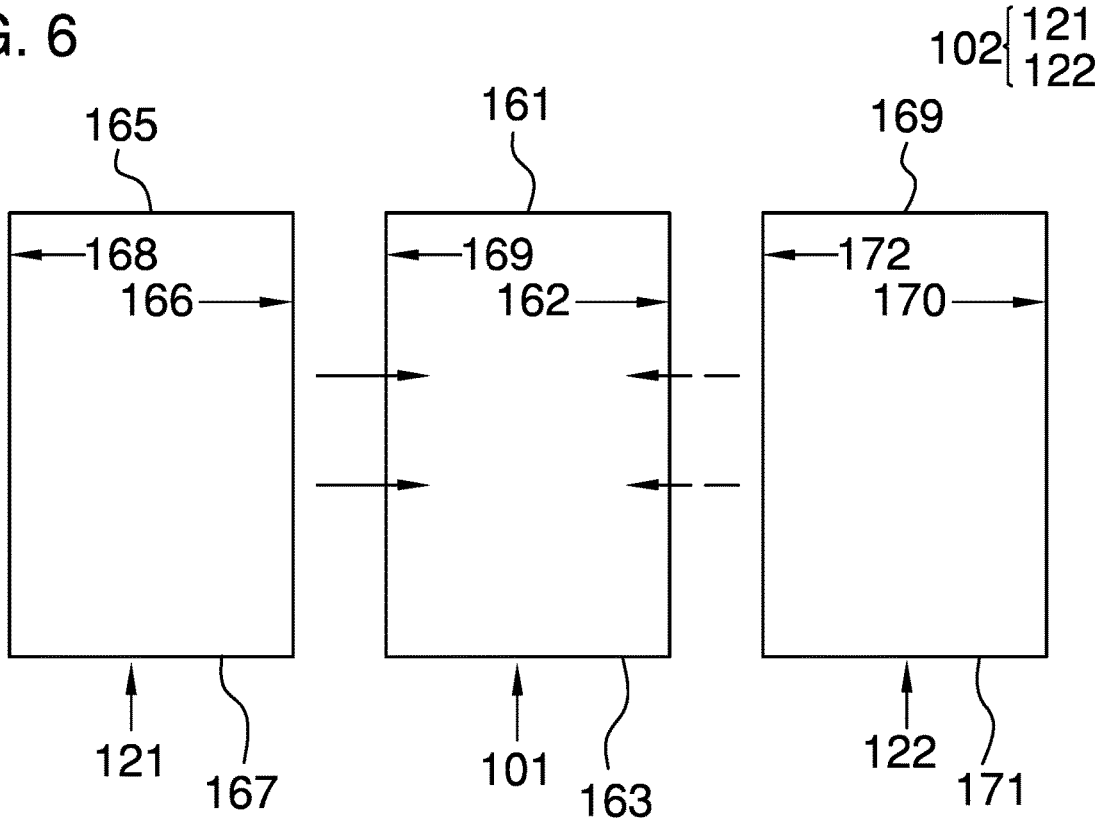
FIG. 6 is a detail view of an embodiment of the disclosure.
Figure 7:
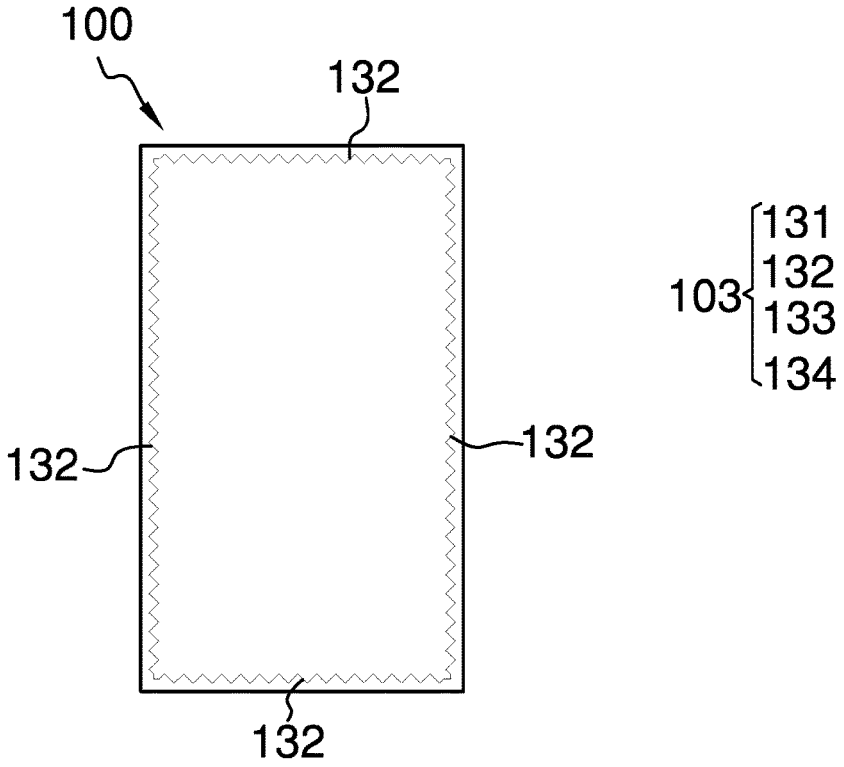
FIG. 7 is a detail view of an embodiment of the disclosure.

Detailed reference will now be made to one or more potential embodiments of the disclosure, which are illustrated in FIGS. 1 through 7.

The satin towel 100 (hereinafter invention) is a composite textile structure. The invention 100 is configured for use in drying hair. The invention 100 comprises an absorbent sheeting 1 and one or more satin sheetings 102. The one or more satin sheetings 102 attach to the absorbent sheeting 101 such that each of the one or more satin sheetings 102 forms an exterior surface of the invention 100. The absorbent sheeting 101 wicks water through the one or more satin sheetings 102. Each of the one or more satin sheetings 102 presents a low abrasion surface that is rubbed against the hair.

The absorbent sheeting 101 is a sheeting structure. The absorbent sheeting 101 is a textile based structure. The textile based structure of the absorbent sheeting 101 is selected from the group consisting of: a) a mat structure; and, b) a woven textile structure. The absorbent sheeting 101 is an absorbent structure. The absorbent sheeting 101 uses capillary action to draw water through the one or more satin sheetings 102 for storage within a wicking structure formed by the absorbent sheeting 101. The absorbent sheeting 101 has a rectangular shape. The absorbent sheeting 101 comprises a first face 111 and a second face 112. The absorbent sheeting 101 further comprises a first edge 161, a second edge 162, a third edge 163, and a fourth edge 164.

The first face 111 is the face of the absorbent sheeting with the greatest surface area. The second face 112 is the face of the absorbent sheeting 101 that is distal from the first face 111.

The first edge 161 is the edge of the sheeting structure of the absorbent sheeting 101 with the least span of distance. The first edge 161 forms a vertex with the second edge 162. The second edge 162 is the edge of the sheeting structure of the absorbent sheeting 101 with the greatest span of distance. The second edge 162 forms a vertex with the third edge 163. The third edge 163 is the edge of the sheeting structure of the absorbent sheeting 101 that is distal from the first edge 161. The third edge 163 is parallel to the first edge 161. The third edge 163 forms a vertex with the fourth edge 164. The fourth edge 164 is the edge of the sheeting structure of the absorbent sheeting 101 that is distal from the second edge 162. The fourth edge 164 is parallel to the second edge 162. The fourth edge 164 forms a vertex with the first edge 161.

Each of the one or more satin sheetings 102 is a sheeting. Each of the one or more satin sheetings 102 is a textile based structure. Each of the one or more satin sheetings 102 is a woven structure. The one or more satin sheetings 102 draws water from the exterior of the invention 100 to the absorbent sheeting 101 is the manner of a towel. The form factor of each of the one or more satin sheetings 102 is geometrically similar to the form factor of the absorbent sheeting 101. The perimeter of each of the one or more satin sheetings 102 is greater than or equal to the perimeter of the absorbent sheeting 101. Each of the one or more satin sheetings 102 has a rectangular shape.

Each of the one or more satin sheetings 102 is formed from microfiber yarns using a satin weave. The use of the microfiber yarns is preferred because: a) the microfiber yarn provides for greater capillary action than a non-microfiber yarn; and, b) each filament in the microfiber yarn has a lower tensile break strength than a filament used in a non-microfiber yarn. The lower tensile break strength of the filaments of the microfiber yarn makes it more likely that a hair will damage the microfiber yarn before the microfiber yarn will damage the hair.

In the first potential embodiment of the disclosure, the one or more satin sheetings 102 comprises a first satin sheeting 121. The first satin sheeting 121 is the sheeting selected from the one or more satin sheetings 102 that attaches to the first face 111 of the absorbent sheeting 101 to form the composite textile structure of the invention 100. The first satin sheeting 121 forms a first smooth exterior surface of the invention 100.

The first satin sheeting 121 is a sheeting. The first satin sheeting 121 is a textile based structure. The first satin sheeting 121 is a woven structure. The first satin sheeting 121 draws water from the exterior of the invention 100 to the absorbent sheeting 101 is the manner of a towel. The first satin sheeting 121 is formed from microfiber yarns using a satin weave. The form factor of the first satin sheeting 121 is geometrically similar to the form factor of the absorbent sheeting 101. The perimeter of the first satin sheeting 121 is greater than or equal to the perimeter of the absorbent sheeting 101. The first satin sheeting 121 has a rectangular shape. The first satin sheeting 121 comprises a first satin face 141 and a first base face 142. The first satin sheeting 121 further comprises a fifth edge 165, a sixth edge 166, a seventh edge 167, and an eighth edge 168.

The first satin face 141 is the face of the textile structure of the first satin sheeting 121 with the greatest surface area. The first satin face 141 is the face of the textile structure of the first satin sheeting 121 that forms a first smooth exterior satin surface of the invention 100. The first satin face 141 is the face of the textile structure of the first satin sheeting 121 that is distal from the absorbent sheeting 101. The first base face 142 is the face of the textile structure of the first satin sheeting 121 that is distal from the first satin face 141. The first base face 142 is placed in contact with the first face 111 of the absorbent sheeting 101 such that water wicked into the first satin sheeting 121 will flow into the absorbent sheeting 101.

The fifth edge 165 is the edge of the sheeting structure of the first satin sheeting 121 with the least span of distance. The span of the length of the fifth edge 165 is greater than or equal to the span of the length of the first edge 161 of the absorbent sheeting 101. The fifth edge 165 forms a vertex with the sixth edge 166.

The sixth edge 166 is the edge of the sheeting structure of the first satin sheeting 121 with the greatest span of distance. The span of the length of the sixth edge 166 is greater than or equal to the span of the length of the second edge 162 of the absorbent sheeting 101. The sixth edge 166 forms a vertex with the seventh edge 167.

The seventh edge 167 is the edge of the sheeting structure of the first satin sheeting 121 that is distal from the fifth edge 165. The seventh edge 167 is parallel to the fifth edge 165. The span of the length of the seventh edge 167 is greater than or equal to the span of the length of the third edge 163 of the absorbent sheeting 101. The seventh edge 167 forms a vertex with the eighth edge 168.

The eighth edge 168 is the edge of the sheeting structure of the first satin sheeting 121 that is distal from the fifth edge 165. The eighth edge 168 is parallel to the sixth edge 166. The span of the length of the eighth edge 168 is greater than or equal to the span of the length of the fourth edge 164 of the absorbent sheeting 101. The eighth edge 168 forms a vertex with the fifth edge 165.

Each of the plurality of seams 103 joins an edge of the absorbent sheeting 101 to an edge of each of the one or more satin sheetings 102 to form a single composite textile structure. In the first potential embodiment of the disclosure, each of the plurality of seams 103 is a sewn seam. The plurality of seams 103 further comprises a first seam 131, a second seam 132, a third seam 133, and a fourth seam 134.

The first seam 131 is a sewn seam. The first seam 131 attaches the fifth edge 165 of the first satin sheeting 121 to the first edge 161 of the absorbent sheeting 101. The second seam 132 is a sewn seam. The second seam 132 attaches the sixth edge 166 of the first satin sheeting 121 to the second edge 162 of the absorbent sheeting 101. The third seam 133 is a sewn seam. The third seam 133 attaches the seventh edge 167 of the first satin sheeting 121 to the third edge 163 of the absorbent sheeting 101. The fourth seam 134 is a sewn seam. The fourth seam 134 attaches the eighth edge 168 of the first satin sheeting 121 to the fourth edge 164 of the absorbent sheeting 101.

In a second potential embodiment of the disclosure, the one or more satin sheetings 102 further comprises a second satin sheeting 122. The second satin sheeting 122 is the sheeting selected from the one or more satin sheetings 102 that attaches to the second face 112 of the absorbent sheeting 101 to form the composite textile structure of the invention 100. The second satin sheeting 122 forms a second smooth exterior surface of the invention 100.

The second satin sheeting 122 is a sheeting. The second satin sheeting 122 is a textile based structure. The second satin sheeting 122 is a woven structure. The second satin sheeting 122 draws water from the exterior of the invention 100 to the absorbent sheeting 101 is the manner of a towel. The second satin sheeting 122 is formed from microfiber yarns using a satin weave. The form factor of the second satin sheeting 122 is geometrically similar to the form factor of the absorbent sheeting 101. The perimeter of the second satin sheeting 122 is greater than or equal to the perimeter of the absorbent sheeting 101. The second satin sheeting 122 has a rectangular shape. The first satin sheeting 121 comprises a second satin face 151 and a second base face 152. The first satin sheeting 121 further comprises a ninth edge 169, a tenth edge 170, an eleventh edge 171, and a twelfth edge 172.

The second satin face 151 is the face of the textile structure of the second satin sheeting 122 with the greatest surface area. The second satin face 151 is the face of the textile structure of the second satin sheeting 122 that forms a second smooth exterior satin surface of the invention 100. The second satin face 151 is the face of the textile structure of the second satin sheeting 122 that is distal from the absorbent sheeting 101. The second base face 152 is the face of the textile structure of the second satin sheeting 122 that is distal from the second satin face 151. The second base face 152 is placed in contact with the second face 112 of the absorbent sheeting 101 such that water wicked into the second satin sheeting 122 will flow into the absorbent sheeting 101.

The ninth edge 169 is the edge of the sheeting structure of the second satin sheeting 122 with the least span of distance. The span of the length of the ninth edge 169 is equal to the span of the length of the fifth edge 165 of the first satin sheeting 121. The ninth edge 169 forms a vertex with the tenth edge 170.

The tenth edge 170 is the edge of the sheeting structure of the second satin sheeting 122 with the greatest span of distance. The span of the length of the tenth edge 170 is equal to the span of the length of the sixth edge 166 of the first satin sheeting 121. The tenth edge 170 forms a vertex with the eleventh edge 171.

The eleventh edge 171 is the edge of the sheeting structure of the second satin sheeting 122 that is distal from the ninth edge 169. The eleventh edge 171 is parallel to the ninth edge 169. The span of the length of the eleventh edge 171 is equal to the span of the length of the seventh edge 167 of the first satin sheeting 121. The eleventh edge 171 forms a vertex with the twelfth edge 172.

The twelfth edge 172 is the edge of the sheeting structure of the second satin sheeting 122 that is distal from the ninth edge 169. The twelfth edge 172 is parallel to the tenth edge 170. The span of the length of the twelfth edge 172 is equal to the span of the length of the eighth edge 168 of the first satin sheeting 121. The twelfth edge 172 forms a vertex with the ninth edge 169.

In the second potential embodiment of the disclosure, the first seam 131 attaches the ninth edge 169 of the second satin sheeting 122, the fifth edge 165 of the first satin sheeting 121, and the first edge 161 of the absorbent sheeting 101 into a single joined edge of the composite prism structure that forms the invention 100.

The second seam 132 attaches the tenth edge 170 of the second satin sheeting 122, the sixth edge 166 of the first satin sheeting 121, and the second edge 162 of the absorbent sheeting 101 into a single joined edge of the composite prism structure that forms the invention 100.

The third seam 133 attaches the eleventh edge 171 of the second satin sheeting 122, the seventh edge 167 of the first satin sheeting 121, and the third edge 163 of the absorbent sheeting 101 into a single joined edge of the composite prism structure that forms the invention 100.

The fourth seam 134 attaches the twelfth edge 172 of the second satin sheeting 122, the eighth edge 168 of the first satin sheeting 121, and the fourth edge 164 of the absorbent sheeting 101 into a single joined edge of the composite prism structure that forms the invention 100.

The following definitions were used in this disclosure:

Abrasion: As used in this disclosure, abrasion refers to the rubbing of a first object against a second object in a manner that generates friction.

Absorbent: As used in this disclosure, absorbent is an adjective that refers to a material that is able to soak up a liquid such as water.

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Capillary Action: As used in this disclosure, capillary action refers to the tendency of a liquid to experience adhesion forces when exposed to surface or surfaces formed within a narrow structure and the tendency of a liquid to flow as a result of these adhesion force. In the proper circumstances, the adhesive forces of capillary action can overcome gravitational forces or the intermolecular forces that form liquids. The span of the lengths where capillary action predominates is often referred to as a microfluidic scale. On a practical level, the concept of wicking and wicking fabrics rely primarily on capillary action.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Composite Textile: As used in this disclosure, a composite textile is a multilayer fabric made of two or more joined layers of textile or sheeting materials.

Compress: In this disclosure, compress means to apply a forces to force a fixed mass of material into a smaller space.

Cord: As used in this disclosure, a cord is a long, thin, flexible, and prism shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, yarn, and rope are synonyms for cord.

Correspond: As used in this disclosure, the term correspond is used as a comparison between two or more objects wherein one or more properties shared by the two or more objects match, agree, or align within acceptable manufacturing tolerances.

Cotton: As used in this disclosure, cotton is a fibrous material derived from the cotton plant. Cotton has a cellulous structure and is commonly used in the formation of yarns used in textile products.

Denier: As used in this disclosure, the term denier is a unit of weight used to describe the fineness of a yarn including, but not limited to, nylon, polyester, rayon, elastomeric, and silk yarns. Denier is calculated as grams per 9000 meters.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Fiber: As used in this disclosure, a fiber is a slender elongated structure.

Filament: As used in this disclosure, a filament is a thread like fiber or object that is used in the production of a yarn.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hair: As used in this disclosure, hair is refers to the fibrous keratin-based structure commonly seen growing from the skin of mammals.

Interlace: As used in this disclosure, to interlace means to align a series of linear objects selected in an alternating manner. The linear objects are selected from two or more groups of linear objects. The alternating manner is a function of the group the linear object is identified with.

Keratin: As used in this disclosure, keratin refers to a fibrous class of a protein often used for structural purposes in a living organism. The protein structure of keratin will vary between species and with the structural function of the keratin within a species.

Mat: As used in this disclosure, a mat refers to a compressible three dimensional structure formed from tangled cords.

Microfiber Yarn: As used in this disclosure, a yarn is said to be a microfiber yarn when the average number of filaments or fibers contained in a cross-section of the yarn is greater than the denier of the yarn. Stated differently, a microfiber yarn is a yarn made from fibers or filaments with an average fineness, as measured by denier, of less than one denier. Please note: This definition is similar to but differs from the definition of microfiber yarn that is generally accepted in the textile industry. This definition is preferred in this disclosure because of the relative simplicity of the definition and because the difference between the two definitions has little commercial or practical relevance.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protein: As used in this disclosure, a protein refers to a molecular sequence of amino acids. Unless otherwise stated in this disclosure, a protein is exclusively formed from the standard amino acids. The order of the standard amino acids within the protein is said to be the primary structure of the protein. A protein that is formed from biological mechanisms is formed with a series of secondary, tertiary, and quaternary bonds that form the secondary, tertiary, and quaternary structure that form the characteristic shape of the specific protein. A protein that has had one or more of the secondary, tertiary, and quaternary bonds broken is said to be denatured.

Rub: As used in this disclosure, to rub is a verb that means to slide a first object against a second object such that friction is generated between the two objects.

Satin: As used in this disclosure, a satin is a smooth fabric made of silk or man-made fibers using a satin weave.

Satin Weave: As used in this disclosure, a satin weave is a weaving pattern in which the face of the fabric is formed almost completely of warp end or weft floats that are produced in the repeat of the weave. The weave produced a characteristic smooth surface on at least one face of the fabric. The satin weave is considered one of the basic weaving patterns. As used in this disclosure satin weaves may be combined with other weave patterns to improve the satin performance characteristics, such as elongation or abrasion resistance, so long as the characteristic smooth surface is maintained.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, a laser bonded seam, a radio frequency (RF) bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Tangle: As used in this disclosure, a tangle refers to a plurality of cord structures that are randomly interlaced to form a single structure.

Textile: As used in this disclosure, a textile is a material that is woven, knitted, braided or felted. Synonyms in common usage for this definition include fabric and cloth. The two surfaces of the textile with the greatest surface area are called the faces of the textile.

Weave: As used in this disclosure, to weave is a verb that means to interlace yarns to form a textile structure. Industrial forms of weaving include, but are not limited to, weaving, braiding, knitting, and twisting. In common usage, the term weaving can be expanded to incorporate cord like structures. For example, the interlacing of hair is commonly called a hair weave. A non-woven textile is a sheeting structure that is formed from yarns or filaments using a process other than weaving.

Wick: As used in this disclosure, a wick is a textile material that uses capillary action to draw a liquid out of a reservoir for subsequent use. The use of wicks is well-known and documented in the chemical arts. The process of drawing a liquid through a wick is commonly called wicking.

Yarn: As used in this disclosure, a yarn is a continuous strand of textile fibers and filaments. Yarns are generally used in the production of fabrics. For the purposes of this disclosure, this definition explicitly includes yarns formed from a single filament, such as a monofilament yarn.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A satin towel comprising an absorbent sheeting and one or more satin sheetings;

wherein the one or more satin sheetings attach to the absorbent sheeting such that each of the one or more satin sheetings forms an exterior surface of the satin towel;

wherein the satin towel is a composite textile structure;

wherein the absorbent sheeting wicks water through the one or more satin sheetings;

wherein each of the one or more satin sheetings presents a low abrasion surface;

wherein the form factor of each of the one or more satin sheetings is geometrically similar to the form factor of the absorbent sheeting;

wherein the perimeter of each of the one or more satin sheetings is greater than or equal to the perimeter of the absorbent sheeting;

wherein each of the one or more satin sheetings has a rectangular shape;

wherein each of the one or more satin sheetings is formed from microfiber yarns using a satin weave;

wherein the absorbent sheeting comprises a first face and a second face;

wherein the first face is the face of the absorbent sheeting with the greatest surface area;

wherein the second face is the face of the absorbent sheeting that is distal from the first face;

wherein the one or more satin sheetings further comprises a first satin sheeting, and a second satin sheeting.

2. The satin towel according to claim 1 wherein the absorbent sheeting is a sheeting structure;

wherein the absorbent sheeting is a textile based structure;

wherein the textile based structure of the absorbent sheeting is selected from the group consisting of: a) a mat structure; and, b) a woven textile structure.

3. The satin towel according to claim 2 wherein the absorbent sheeting is an absorbent structure;

wherein the absorbent sheeting uses capillary action to draw water through the one or more satin sheetings for storage within a wicking structure formed by the absorbent sheeting;

wherein the absorbent sheeting has a rectangular shape.

4. The satin towel according to claim 3 wherein each of the one or more satin sheetings is a sheeting;

wherein each of the one or more satin sheetings is a textile based structure;

wherein each of the one or more satin sheetings is a woven structure;

wherein the one or more satin sheetings draws water from the exterior of the satin towel to the absorbent sheeting.

5. The satin towel according to claim 4 wherein each of the plurality of seams joins an edge of the absorbent sheeting to an edge of each of the one or more satin sheetings to form a single composite textile structure.

6. The satin towel according to claim 5
wherein the absorbent sheeting further comprises a first edge, a second edge, a third edge, and a fourth edge;
wherein the first edge is the edge of the sheeting structure of the absorbent sheeting with the least span of distance;
wherein the first edge forms a vertex with the second edge;
wherein the second edge is the edge of the sheeting structure of the absorbent sheeting with the greatest span of distance;
wherein the second edge forms a vertex with the third edge;
wherein the third edge is the edge of the sheeting structure of the absorbent sheeting that is distal from the first edge;
wherein the third edge is parallel to the first edge;
wherein the third edge forms a vertex with the fourth edge;
wherein the fourth edge is the edge of the sheeting structure of the absorbent sheeting that is distal from the second edge;
wherein the fourth edge is parallel to the second edge;
wherein the fourth edge forms a vertex with the first edge.

7. The satin towel according to claim 6
wherein the first satin sheeting is the sheeting selected from the one or more satin sheetings that attaches to the first face of the absorbent sheeting to form the composite textile structure of the satin towel;
wherein the first satin sheeting forms a first smooth exterior surface of the satin towel.

8. The satin towel according to claim 7
wherein the first satin sheeting is a sheeting;
wherein the first satin sheeting is a textile based structure;
wherein the first satin sheeting is a woven structure;
wherein the first satin sheeting draws water from the exterior of the satin towel to the absorbent sheeting is the manner of a towel;
wherein the first satin sheeting is formed from microfiber yarns using a satin weave.

9. The satin towel according to claim 8
wherein the form factor of the first satin sheeting is geometrically similar to the form factor of the absorbent sheeting;
wherein the perimeter of the first satin sheeting is greater than or equal to the perimeter of the absorbent sheeting;
wherein the first satin sheeting has a rectangular shape.

10. The satin towel according to claim 9
wherein the first satin sheeting comprises a first satin face and a first base face;
wherein the first satin face is the face of the textile structure of the first satin sheeting with the greatest surface area;
wherein the first satin face is the face of the textile structure of the first satin sheeting that forms a first smooth exterior satin surface of the satin towel;
wherein the first satin face is the face of the textile structure of the first satin sheeting that is distal from the absorbent sheeting;
wherein the first base face is the face of the textile structure of the first satin sheeting that is distal from the first satin face;
wherein the first base face is placed in contact with the first face of the absorbent sheeting such that water wicked into the first satin sheeting will flow into the absorbent sheeting.

11. The satin towel according to claim 10
wherein the first satin sheeting further comprises a fifth edge, a sixth edge, a seventh edge, and an eighth edge;
wherein the fifth edge is the edge of the sheeting structure of the first satin sheeting with the least span of distance;
wherein the span of the length of the fifth edge is greater than or equal to the span of the length of the first edge of the absorbent sheeting;
wherein the fifth edge forms a vertex with the sixth edge;
wherein the sixth edge is the edge of the sheeting structure of the first satin sheeting with the greatest span of distance;
wherein the span of the length of the sixth edge is greater than or equal to the span of the length of the second edge of the absorbent sheeting;
wherein the sixth edge forms a vertex with the seventh edge;
wherein the seventh edge is the edge of the sheeting structure of the first satin sheeting that is distal from the fifth edge;
wherein the seventh edge is parallel to the fifth edge;
wherein the span of the length of the seventh edge is greater than or equal to the span of the length of the third edge of the absorbent sheeting;
wherein the seventh edge forms a vertex with the eighth edge;
wherein the eighth edge is the edge of the sheeting structure of the first satin sheeting that is distal from the fifth edge;
wherein the eighth edge is parallel to the sixth edge;
wherein the span of the length of the eighth edge is greater than or equal to the span of the length of the fourth edge of the absorbent sheeting;
wherein the eighth edge forms a vertex with the fifth edge.

12. The satin towel according to claim 11
wherein the plurality of seams further comprises a first seam, a second seam, a third seam, and a fourth seam;
wherein the first seam is a sewn seam;
wherein the first seam attaches the fifth edge of the first satin sheeting to the first edge of the absorbent sheeting;
wherein the second seam is a sewn seam;
wherein the second seam attaches the sixth edge of the first satin sheeting to the second edge of the absorbent sheeting;
wherein the third seam is a sewn seam;
wherein the third seam attaches the seventh edge of the first satin sheeting to the third edge of the absorbent sheeting;
wherein the fourth seam is a sewn seam;
wherein the fourth seam attaches the eighth edge of the first satin sheeting to the fourth edge of the absorbent sheeting.

13. The satin towel according to claim 12
wherein the second satin sheeting is the sheeting selected from the one or more satin sheetings that attaches to the second face of the absorbent sheeting to form the composite textile structure of the satin towel;
wherein the second satin sheeting forms a second smooth exterior surface of the satin towel.

14. The satin towel according to claim 13
wherein the second satin sheeting is a sheeting;

wherein the second satin sheeting is a textile based structure;

wherein the second satin sheeting is a woven structure;

wherein the second satin sheeting draws water from the exterior of the satin towel to the absorbent sheeting is the manner of a towel;

wherein the second satin sheeting is formed from microfiber yarns using a satin weave;

wherein the form factor of the second satin sheeting is geometrically similar to the form factor of the absorbent sheeting;

wherein the perimeter of the second satin sheeting is greater than or equal to the perimeter of the absorbent sheeting;

wherein the second satin sheeting has a rectangular shape.

15. The satin towel according to claim 14 wherein the first satin sheeting comprises a second satin face and a second base face;

wherein the second satin face is the face of the textile structure of the second satin sheeting with the greatest surface area;

wherein the second satin face is the face of the textile structure of the second satin sheeting that forms a second smooth exterior satin surface of the satin towel;

wherein the second satin face is the face of the textile structure of the second satin sheeting that is distal from the absorbent sheeting;

wherein the second base face is the face of the textile structure of the second satin sheeting that is distal from the second satin face;

wherein the second base face is placed in contact with the second face of the absorbent sheeting such that water wicked into the second satin sheeting will flow into the absorbent sheeting.

16. The satin towel according to claim 15 wherein the second satin sheeting further comprises a ninth edge, a tenth edge, an eleventh edge, and a twelfth edge;

wherein the ninth edge is the edge of the sheeting structure of the second satin sheeting with the least span of distance;

wherein the span of the length of the ninth edge is equal to the span of the length of the fifth edge of the second satin sheeting;

wherein the ninth edge forms a vertex with the tenth edge;

wherein the tenth edge is the edge of the sheeting structure of the second satin sheeting with the greatest span of distance;

wherein the span of the length of the tenth edge is equal to the span of the length of the sixth edge of the second satin sheeting;

wherein the tenth edge forms a vertex with the eleventh edge;

wherein the eleventh edge is the edge of the sheeting structure of the second satin sheeting that is distal from the ninth edge;

wherein the eleventh edge is parallel to the ninth edge;

wherein the span of the length of the eleventh edge is equal to the span of the length of the seventh edge of the second satin sheeting;

wherein the eleventh edge forms a vertex with the twelfth edge;

wherein the twelfth edge is the edge of the sheeting structure of the second satin sheeting that is distal from the ninth edge;

wherein the twelfth edge is parallel to the tenth edge;

wherein the span of the length of the twelfth edge is equal to the span of the length of the eighth edge of the second satin sheeting;

wherein the twelfth edge forms a vertex with the ninth edge.

17. The satin towel according to claim 16 wherein the plurality of seams comprises a first seam, a second seam, a third seam, and a fourth seam;

wherein the first seam attaches the ninth edge of the second satin sheeting, the fifth edge of the second satin sheeting, and the first edge of the absorbent sheeting into a single joined edge of the composite prism structure that forms the satin towel;

wherein the second seam attaches the tenth edge of the second satin sheeting, the sixth edge of the second satin sheeting, and the second edge of the absorbent sheeting into a single joined edge of the composite prism structure that forms the satin towel;

wherein the third seam attaches the eleventh edge of the second satin sheeting, the seventh edge of the second satin sheeting, and the third edge of the absorbent sheeting into a single joined edge of the composite prism structure that forms the satin towel;

wherein the fourth seam attaches the twelfth edge of the second satin sheeting, the eighth edge of the second satin sheeting, and the fourth edge of the absorbent sheeting into a single joined edge of the composite prism structure that forms the satin towel.

* * * * *